US007313892B1

(12) United States Patent
Oliver et al.

(10) Patent No.: US 7,313,892 B1
(45) Date of Patent: Jan. 1, 2008

(54) SUPPORT FOR MANUFACTURED HOUSING

(76) Inventors: James E. Oliver, P.O. Box 9, Hohenwald, TN (US) 38462; Evon Oliver, P.O. Box 9, Hohenwald, TN (US) 38462; Daniel Oliver, P.O. Box 9, Hohenwald, TN (US) 38462; Scott Oliver, P.O. Box 9, Hohenwald, TN (US) 38462; John Oliver, P.O. Box 9, Hohenwald, TN (US) 38462

( * ) Notice: Subject to any disclaimer, the term of this patent is extended or adjusted under 35 U.S.C. 154(b) by 629 days.

(21) Appl. No.: 10/845,339

(22) Filed: May 13, 2004

(51) Int. Cl.
*E04C 1/00* (2006.01)

(52) U.S. Cl. ..... 52/309.1; 52/592.6; 52/582; 52/169.9; 52/300

(58) Field of Classification Search ..... 52/592.6, 52/606, 582, 594, 169.9, 736.1, 301, 309.1, 52/300; D34/38
See application file for complete search history.

(56) References Cited

U.S. PATENT DOCUMENTS 4,026,086 A * 5/1977 Langley ..... 52/592.6
4,189,125 A 2/1980 Little
4,744,780 A * 5/1988 Volpe ..... 446/128
4,869,456 A 9/1989 Jacobs
4,926,595 A 5/1990 Dean, Jr.
5,419,524 A 5/1995 Evans et al.
D378,838 S * 4/1997 Olsen et al. ..... D21/486
5,664,394 A 9/1997 Sweeney
5,809,905 A 9/1998 John et al.
D417,765 S * 12/1999 Morello ..... D34/38
D426,933 S * 6/2000 Redfern ..... D34/38
D433,157 S 10/2000 Whitson
6,223,489 B1 5/2001 Fisher
D445,148 S * 7/2001 McIntosh ..... D21/500
6,386,118 B1 * 5/2002 Bendit et al. ..... 108/57.25
6,415,562 B1 7/2002 Donaghue et al.
6,662,515 B2 12/2003 Buhrts et al.
D485,659 S * 1/2004 Medoff et al. ..... D34/38
D486,246 S 2/2004 Manthei
D517,702 S * 3/2006 Oliver et al. ..... D25/135

* cited by examiner

*Primary Examiner*—Basil Katcheves
(74) *Attorney, Agent, or Firm*—Calif Tervo; Palomar Patent

(57) ABSTRACT

A pier cap for a disposition atop a pier of support for a structure, such as a manufactured home generally comprises a rectangular body having a generally flat planar textured top and support webs including a peripheral, downward extending wall and a plurality of internal webs and an open interior in the body between the webs. The webs are designed to be supported by the upper surface of a concrete block having vertical cells. Coupling projections, connected to the body and rising above the top, couple with the webs of a stacked cap to prevent sliding. The pier caps can be arranged in stacked layers of multiple caps.

14 Claims, 3 Drawing Sheets

FIG. 9
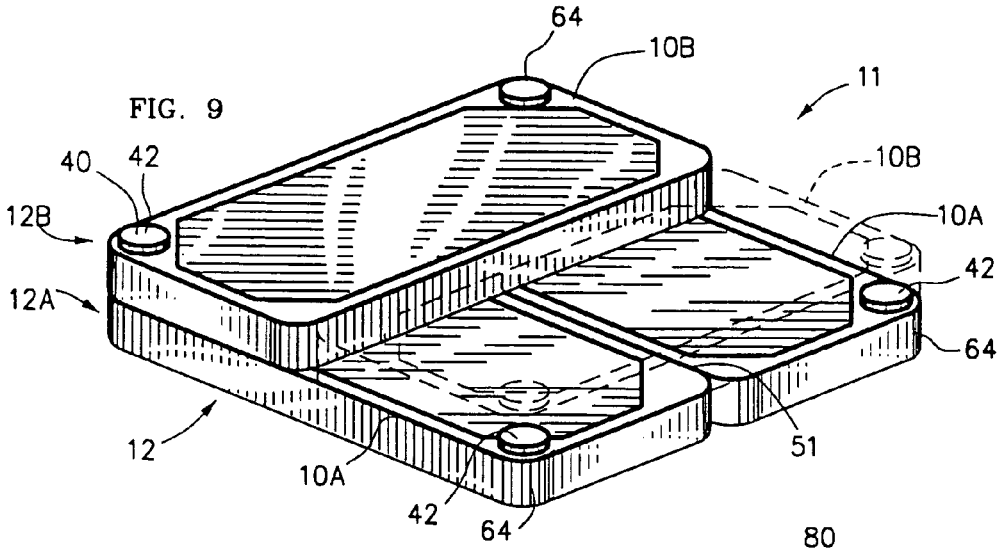
FIG. 8
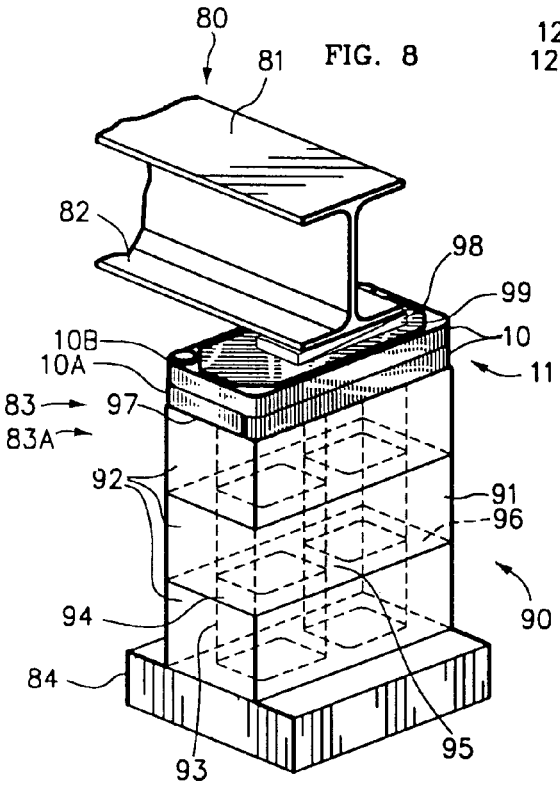
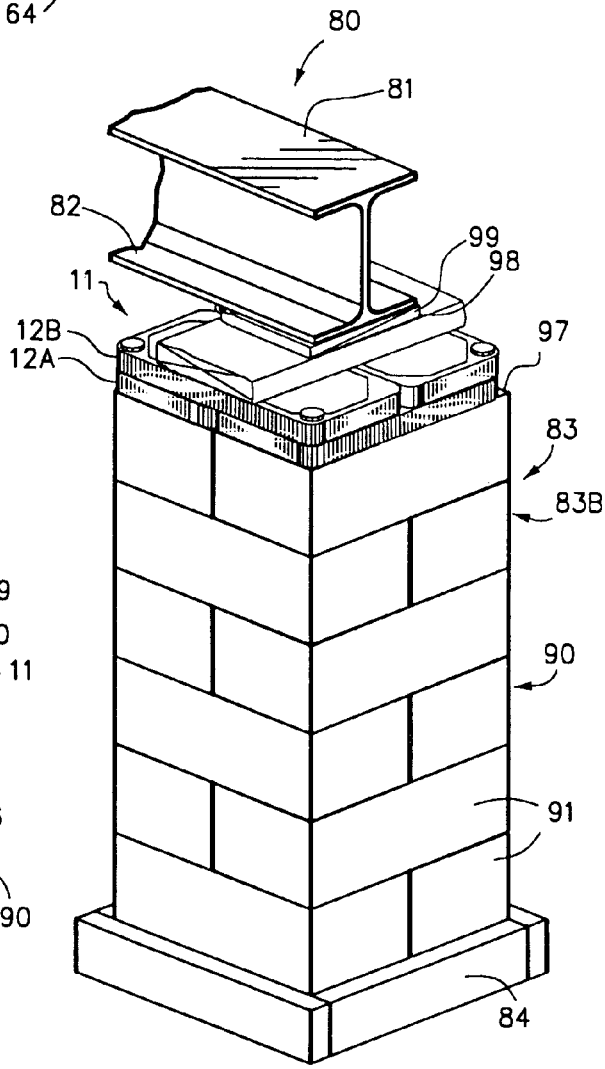
FIG. 10

SUPPORT FOR MANUFACTURED HOUSING

FIELD OF THE INVENTION

This invention relates in general to pier supports for structures, and more specifically involves a pier cap.

BACKGROUND OF THE INVENTION

The main beam of a manufactured home is supported by a plurality of supports. A support comprises a pier having a top below the beam and various elements filling in the space between the pier and the beam to support the home. A pier cap is placed on top of the pier to interface the pier with typically smaller shims directly supporting the beam. Conventional pier caps are of wood and suffer from many shortcomings. Wooden pier caps shrink or expand depending on the moisture. Conventional wooden pier caps are quite heavy for shipping purposes. Some wooden pier caps are treated with chemicals which may be environmentally harmful. Wooden pier caps are subject to warping and splitting. Wooden pier caps are subject to insect attack, such as by termites. When conventional pier caps are stacked, they may easily slide on one another, which produces instability.

Therefore, there has been a need for an improved pier cap; preferably one made of plastic or other non-deteriorating material; one that weighs less than a conventional pier cap; one that will not change size due to changes in moisture; one that contains no environmentally harmful chemicals; and one that couples with stacked pier caps to prevent relative movement.

SUMMARY OF THE INVENTION

This invention is a pier cap for a pier of support for a structure, such as a manufactured home. In a preferred embodiment, the pier cap generally comprises a rectangular body having a generally flat planar top and support webs including a peripheral, downward extending wall and a plurality of internal webs defining an open interior in the body between the webs. Pier caps can be stacked. Coupling projections, connected to the body and rising above the top, couple with the webs of a cap stacked above to prevent sliding. The pier caps can be arranged in stacked layers of multiple caps. The webs are designed to be supported by the upper surface of a concrete block having vertical cells.

Other features and many attendant advantages of the invention will become more apparent upon a reading of the following detailed description together with the drawings wherein like reference numerals refer to like parts throughout.

BRIEF DESCRIPTION OF THE DRAWINGS

FIG. 8 is a partially cut away, perspective view of a support for structure including a stack of pier caps of FIG. 1;

FIG. 9 is a perspective view of an alternating stacking (or "cross stacking") of pier caps of FIG. 1; and FIG. 10 is a partially cut away, perspective view of a support for a structure including the alternating stack of FIG. 9

DETAILED DESCRIPTION OF THE INVENTION

Figure 1:
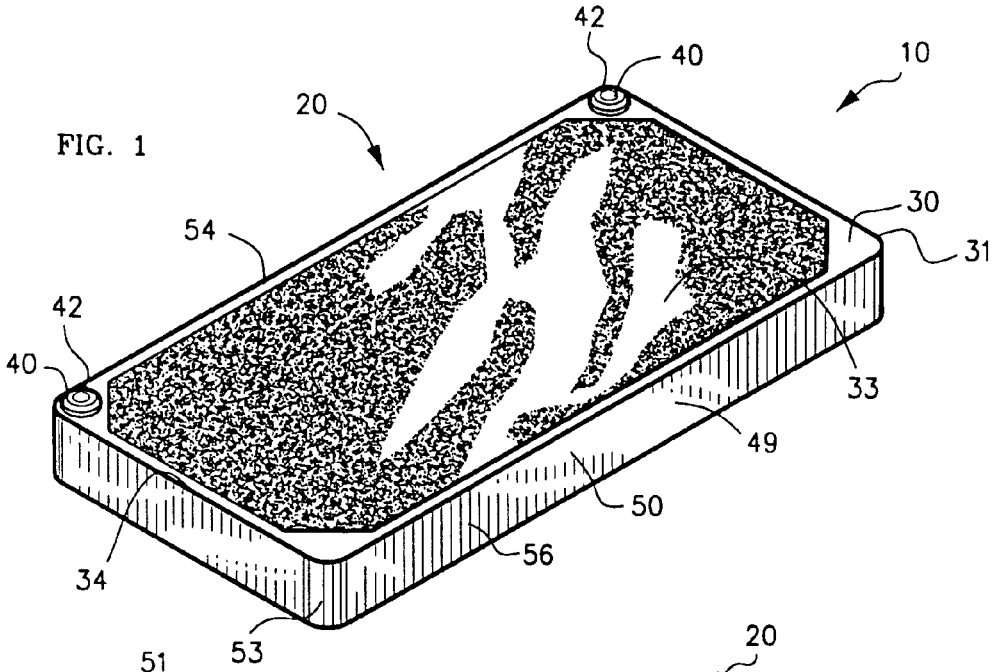
FIG. 1 is a top, left, front, perspective view of a pier cap of the invention.

Looking first at FIG. 8, there is shown a typical environment of the pier cap 10 of the invention in use. FIG. 8 is a partially cut away, perspective view of a support 83, such as small support 83A, for structure, such as a manufactured home 80. Manufactured home 80 includes a main support beam, such as beam 81 having a flanged bottom 82. Support 83A is disposed under beam 81 and may be directly supported by the ground or by a foundation, such as of concrete. Support 83A generally includes a footing 84, a pier 90 on footing 84, a stack 11 of one or more pier caps 10 on top 97 of pier 90, and shims 98, such as wedges 99 on top of top pier cap 10. Wedges 99 may be made of suitable strong material, such as wood or plastic.

Footing 84 is typically a concrete slab and is generally supported by the ground, but could be supported by a foundation. Pier 90 typically constitutes the majority of the height of support 83. A typical pier 90 includes a stack of blocks 91 that may be made of any of many strong suitable materials. Blocks 91 may be solid or may be celled concrete blocks 92 including one or more cells 93, shown in phantom. A typical two-celled concrete block 92 is substantially a parallelepiped having length of twice the width. Typical dimensions are approximately eight inches by eight inches by sixteen inches. Celled block 92 includes two vertical cells 93, as shown in phantom, surrounded by a peripheral wall 94 and separated by a central lateral wall 95. Peripheral wall 94 and lateral wall 95 have an upper surface 96. Blocks 91 are typically built up to within a block height of beam 81. Although a two-celled block 92 is shown and described, other cell configurations may be used. Although a finishing block having flat end faces is shown, a standard construction block having a concave end surface could be used.

Stack 11 of pier caps 10, disposed on top of pier 90, includes bottom pier cap 10A connected to second pier cap 10B. The height of pier caps 10 is typically one to two inches, much less than the height of block 91, such that a stack 11 of pier caps 10 is used to fill in most the distance between the top 97 of pier 90 and flanged bottom 82 of beam 81. Shims 98, such as thin boards and wedges 99, are inserted between top pier cap 10, such as 10B and beam 81 to prove overall proper height of support 83. Wedges 99 can later be adjusted to finely adjust the height as conditions change, such as from ground settling.

Figure 2:
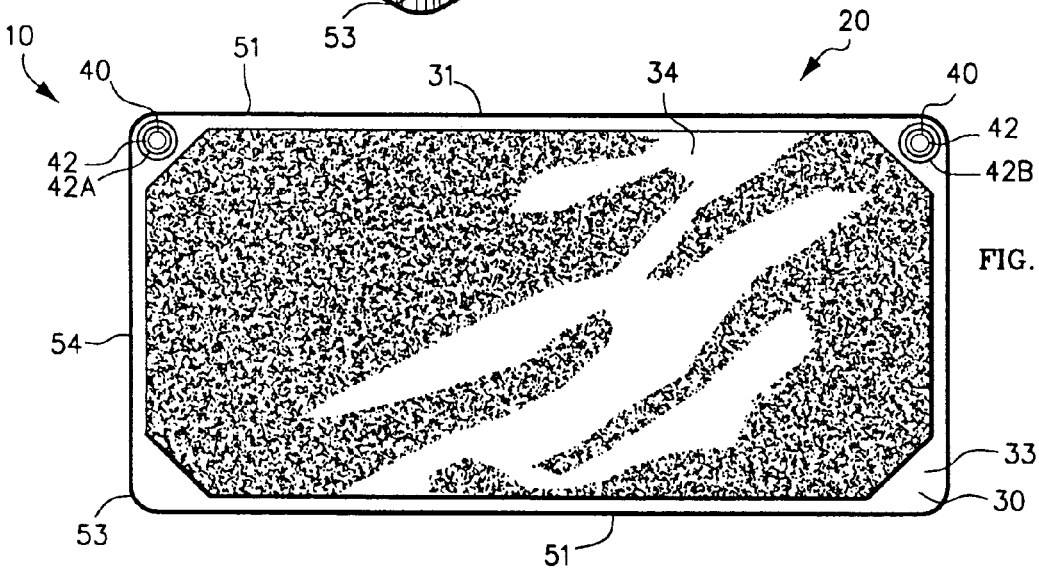
FIG. 2 is a top plan view thereof.
Figure 3:
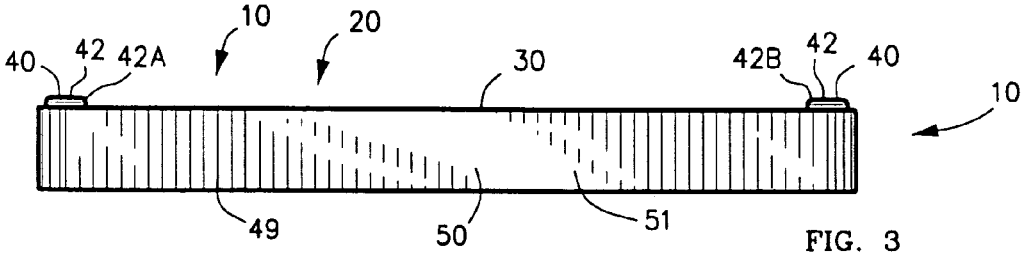
FIG. 3 is a front elevation view thereof; the rear elevation view being a mirror image.
Figure 4:
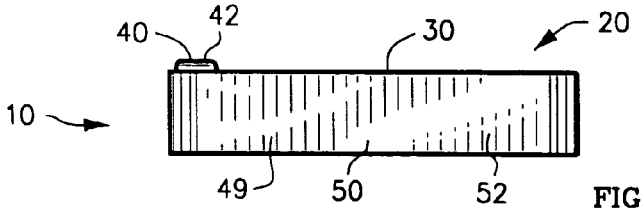
FIG. 4 is a left side elevation view thereof.
Figure 5:
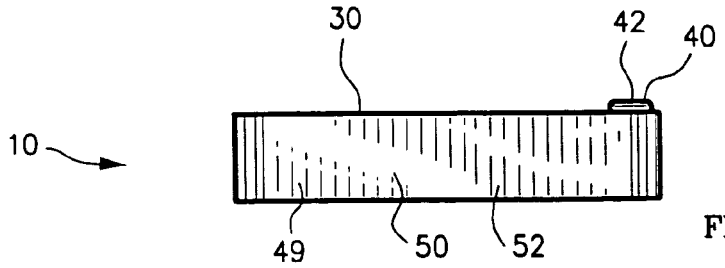
FIG. 5 is a right side elevation view thereof.
Figure 6:
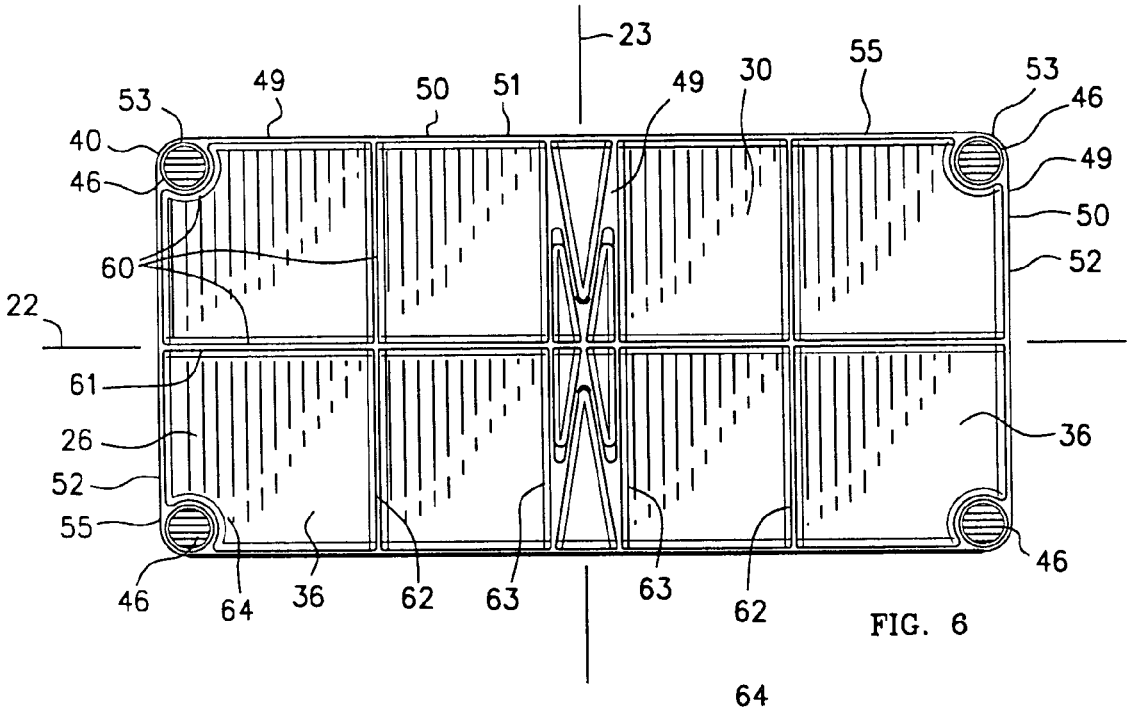
FIG. 6 is a bottom plan view thereof.
Figure 7:
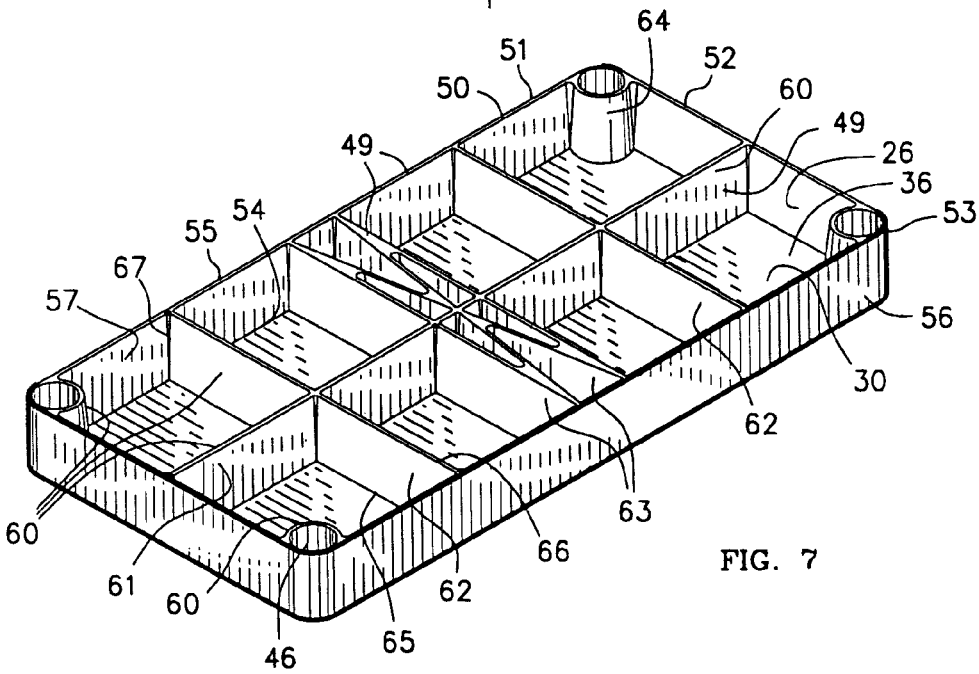
FIG. 7 is a bottom perspective view thereof.

With reference now to FIGS. 1-7 of the drawings, there is shown a preferred embodiment of a pier cap 10 with FIG. 1 being a top, left, front, perspective view, FIG. 2 being a top plan view, FIG. 3 being a front elevation view thereof, the rear elevation view being a mirror image, FIG. 4 being a left side elevation view, FIG. 5 being a right side elevation view, FIG. 6 being a bottom plan view, and FIG. 7 being a bottom perspective view.

Pier cap 10 generally comprises a body 20 having a top 30, webs 49 including a peripheral web 50 and internal webs 60 (seen in FIGS. 6 and 7), and coupling means 40, including projections 42. Top 30 has an exterior surface 33 that is substantially a horizontal planar member, a periphery 31 and an interior surface 36. Preferably, exterior surface 33 includes friction enhancing texturing 34 to aid in keeping shims 98 in place thereon.

Coupling means 40, such as projections 42, such as first projection 42A connected to body 20 and projecting above top 30 and second projection 42B connected to body 20 and projecting above top 30, couples with webs 49 of a pier cap 10 stacked thereon such that the stacked pier caps 10 cannot slide horizontally with respect to one another. This will be explained more fully later.

Peripheral web 50 forms a substantially continuous vertical sidewall. In the preferred embodiment, pier cap 10 is rectangular in top view to correspond to the shape of block 91, and peripheral web 50 includes a pair of side walls 51 defining the lateral direction as between side walls 51 and a pair of end walls 52 defining the longitudinal direction as between end walls 52. Side walls 51 and end walls 52 join at corners 53 which are preferably curved or radiused, but could be sharp. As best seen in FIG. 7, peripheral web 50 includes a top edge 54 connected to periphery 31 of top 30, a bottom edge 55, an interior surface 57 and an exterior surface 56. Preferably, body 20 is adapted such that substantially the entire length of bottom edge 55 of peripheral web 50 is supported by top 97 of pier 90, such as by upper surface 96 of peripheral wall 94 of concrete block 92.

The plurality of internal webs 60 each include a top edge 65 connected to interior surface 36 of top 30, a bottom edge 66, and ends 67 connected to another web 49, such as peripheral web 50. Internal webs 60 include a longitudinal web 61, and lateral webs 62 including a plurality of centrally located lateral webs 63 having bottom edges 66 adapted for being substantially supported by upper surface 96 of central lateral web 95 of said celled top block 92. Internal webs 60 define an open interior 26 in body 20 between webs 49.

Semi-circular corner webs 64 are internal webs 49 that join side walls 51 to end walls 52 at corners 53 and serve to strengthen corners 53 of peripheral web 50 and combine with corners 53 to form receptacles 46 for receiving connecting projections 42 of coupling means 40. Preferably, projections 42 are located so as to not interfere with placement of shims 98 centrally on pier cap 10. Therefore, projections 42 are disposed adjacent periphery 31 of top 30 and, even more preferably, at a corner 53. Preferably, projections 42 are only along one side so as to better facilitate addition of shims from one side. Preferably, projections 42 will also couple with a stacked pier cap 10 if the stacked pier cap 10 is rotated one hundred eighty degrees.

Returning to FIG. 8, pier 80 is comprised of a plurality of vertical cell concrete masonry units, blocks 92. Stack 11 of pier caps 10 include bottom pier cap 10A disposed on top 97 of pier 90. Upper surface 96 of peripheral wall 94 and lateral wall 95 support peripheral web 50 and central lateral webs 63 of bottom pier cap 10A. Second pier cap 10B is disposed atop bottom pier cap 10A such that substantially the entire length of bottom edge 55 of said web 50 and bottom edge 66 of internal webs 60 of second pier cap 10B are supported by exterior surface 56 of top 30 of bottom pier cap 10A. Projections 42 on bottom pier cap 10A couple with receptacles 46 on second pier cap 10B so as to hold second pier cap 10B from horizontal movement. Although, stack 11, shown, includes two pier caps 10, stack may be one or more pier caps 10. Shims 98, such as adjustable shims, such as adjustable wedges 99, are disposed on textured surface 34 of top or second pier cap 10B and fill in the space to beam 81.

Looking now at FIGS. 9 and 10, FIG. 9 is a perspective view of alternating stack 11 of pier caps 10 of FIG. 1, and FIG. 10 is a partially cut away, perspective view of a support 83, such as large support 83B, for a structure 80 including the alternating stack 11 of pier caps 10 of FIG. 9

Large support 83B is representative of a support 83 that requires considerable height or needs to be stronger or more stable than small support 83A. Support 83B includes a footing 84, a pier 90 on footing 84, a stack 11 of one or more layers 12, each having a plurality of pier caps 10, on top 97 of pier 90, and shims 98, such as wedges 99 between stack 11 and bottom 82 of beam 81.

FIG. 9 shows a partial stack 11 of rectangular pier caps 10 having a width of one-half the length. Bottom layer 12A comprises a pair of bottom pier caps 10A disposed on upper surface 97 of pier 90 such that side walls 51 of bottom pier caps 10A are adjacent so as to form a square and such that corner projections 42 are in the four corners of the square.

Second layer 12B of second pier caps 10B are disposed on bottom layer 12A and below beam 81 such that side walls 51 of the two pier caps 10B are adjacent and the longitudinal axis 22 of each second pier cap 10B is perpendicular to longitudinal axes 22 of bottom pier caps 10A and coupling projections 42 of each bottom pier cap 10A couple with webs 49, such as receptacles 46 of second pier caps 10B such that second pier caps 10B cannot slide horizontally relative to bottom pier caps 10A. If second pier caps 10A are the top pier caps then it is preferable that any projections 42 thereon are disposed away from the central axes of stack 11, such as at the corners 64 as shown, so as to be out of the way of shims 98.

Preferably, pier cap 10 is made of plastic by the injection molding process. It may be made of petroleum base materials or composite materials, such as polymers, such as ABS, polypropylene, or polyethylene, or nylon. Because of the web construction, it is lighter in weight than conventional pier caps, which makes it cheaper to ship and easier to handle and place. It will not dry out, change shape, or rot. It does not shrink or expand from moisture. Stacked pier caps interlock in single stack or in double-wide stacks to prevent slippage. The textured top prevents slippage of shims.

Having described the invention, it can be seen that it provides a superior device for construction of a support for a manufactured home.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. In combination:

a structure including:

a support beam; and a support supporting said beam of said structure comprising:

a pier including:

an upper surface located a distance below the beam; and a bottom pier cap disposed on said upper surface of said pier and below said beam comprising:

a body comprising:

a top having:

a periphery;

an exterior surface; and an interior surface;

a peripheral web forming a substantially continuous horizontal sidewall having:
a top edge connected to said periphery of said top of said bottom pier cap;
a bottom edge;
an interior surface; and
an exterior surface; and
a plurality of internal webs each including:
a top edge connected to said interior surface of said top of said bottom pier cap;
a bottom edge below said top edge; said internal webs defining an open interior in said body between said webs of said bottom pier cap; said body of said bottom pier cap adapted such that substantially the entire length of said bottom edge of said peripheral web of said bottom pier cap is supported by said upper surface of said pier.

2. The combination of claim 1 further including:
a second pier cap disposed atop said bottom pier cap; said second pier cap comprising:
a body comprising:
a top having:
a periphery;
an exterior surface; and
an interior surface; said exterior surface of said top of said second pier cap being substantially a horizontal planar member; and
a peripheral web forming a substantially continuous horizontal peripheral sidewall having:
a top edge connected to said periphery of said top of said second pier cap;
a bottom edge;
an interior surface; and
an exterior surface; and
a plurality of internal webs in said body of said second pier cap, each internal web including:
a top edge connected to said interior surface of said top of said second pier cap; and
a bottom edge below said top edge; said webs defining an open interior in said body between said webs; said body adapted such that substantially the entire length of said bottom edge of said peripheral web of said second pier cap is supported by said exterior surface of said top of said bottom pier cap.

3. The support of claim 2 wherein:
said horizontal planar member of said exterior surface of said top of said second pier cap includes friction enhancing texturing.

4. The combination of claim 2 wherein:
said bottom pier cap includes:
coupling means connected to said body and projecting above said top of said bottom pier cap; said coupling means adapted for coupling with said webs of said second pier cap such that said second pier cap cannot slide horizontally relative to said bottom pier cap when coupled thereto.

5. The combination of claim 4 wherein:
said coupling means includes:
a first projection connected to said body of said bottom pier cap and projecting above said top of said bottom pier cap; and
a second projection connected to said body of said bottom pier cap and projecting above said top of said bottom pier cap; said first and said second projections adapted for coupling with said webs of said second pier cap such that said second pier cap cannot move horizontally relative to said bottom pier cap when coupled thereto.

6. The combination of claim 5 wherein:
said first projection is located adjacent said periphery of said top of said bottom pier cap:
said second projection is located adjacent said periphery of said top of said bottom pier cap; the central area of said top of said bottom pier cap being substantially a horizontal planar member.

7. The combination of claim 4 wherein:
said bottom pier cap is rectangular in top view; and
said peripheral web of said bottom pier cap includes:
a pair of side walls defining the lateral direction as between said side walls; and
a pair of end walls defining the longitudinal direction as between said end walls; said side walls of said bottom pier cap connected to said end walls of said bottom pier cap at a corner; and wherein:
said coupling means is located at a said corner or corners; the central area of said top of said bottom pier cap being substantially a horizontal planar member.

8. The combination of claim 1 wherein:
said pier includes:
a stack comprising:
one or more blocks; each said block being rectangular in top view; including:
a top block having said upper surface; and wherein
said bottom pier cap is substantially rectangular in top view; and
said peripheral web includes:
a pair of side walls defining the lateral direction between said side wall; and
a pair of end walls defining the longitudinal direction between said end walls.

9. The combination of claim 8 wherein:
said top block includes:
two or more vertical cells; and
a central lateral web between said cells including an upper surface; and
a peripheral wall including:
an upper surface; and
said plurality of internal webs each includes:
a plurality of central lateral webs; said bottom edges of said plurality of central lateral webs adapted for being substantially supported by the central lateral web of said top block.

10. The combination of claim 1 wherein:
said exterior surface of said top of said pier cap is substantially a horizontal planar member having friction enhancing texturing.

11. In combination:
a structure including:
a support beam; and
a support supporting said beam of said structure comprising:
a pier including:
an upper surface located a distance below the beam;
a bottom layer of a pair of bottom pier caps disposed on said upper surface of said pier; each said bottom pier cap comprising:
a body; said body being substantially rectangular in top view; said body comprising:
a top having:
a periphery;
an exterior surface; and
an interior surface;

a peripheral web forming a substantially continuous horizontal sidewall comprising:
a pair of side walls defining the lateral direction as between said side wall; and
a pair of end walls defining the longitudinal direction as between said end walls of said bottom pier cap; said peripheral web including:
a top edge connected to said periphery of said top of said bottom pier cap;
a bottom edge supported by said block substantially along the entire length of said bottom edge of said bottom pier cap;
an interior surface; and
an exterior surface;

a plurality of internal webs each including:
a top edge connected to said interior surface of said top of said bottom pier cap; and
a bottom edge below said top edge; said internal webs defining an open interior in said body between said webs of said bottom pier cap; and coupling projection means connected to said body and rising above said top of said bottom pier cap; said body of said bottom pier cap adapted such that substantially the entire length of said bottom edge of said peripheral web of said bottom pier cap is supported by said upper surface of said pier; said pair of bottom pier caps disposed on said upper surface of said pier such that said side walls of said bottom pier caps are adjacent; and a second layer of a pair of second pier caps disposed on said bottom layer and below the beam; each said second pier cap comprising:
a body; said body of each said second pier cap being substantially rectangular in top view; said body comprising:
a top having:
a periphery;
an exterior surface; and
an interior surface;
a peripheral web forming a substantially continuous horizontal sidewall comprising:
a pair of side walls defining the lateral direction as between said side wall of each said second pier cap; and
a pair of end walls defining the longitudinal direction as between said end walls of each said second pier cap said peripheral web of each said second pier cap including:
a top edge connected to said periphery of said top of each said second pier cap;
a bottom edge supported by said block substantially along the entire length of said bottom edge of each said second pier cap;
an interior surface; and
an exterior surface; and
a plurality of internal webs each including:
a top edge connected to said interior surface of said top of each said second pier cap; and
a bottom edge below said top edge; said internal webs of each said second pier cap defining an open interior in said body between said webs of each said second pier cap; said body adapted such that substantially the entire length of said bottom edge of said peripheral web of each said second pier cap is supported by said exterior surface of said bottom pier caps; said pair of second pier caps disposed on said bottom pier caps such that said side walls are adjacent and said longitudinal axis of said second pier caps are perpendicular to said longitudinal axes of said bottom pier caps and said coupling projection means of each said bottom pier cap couples with said webs of said second pier caps such that said second pier caps cannot slide horizontally relative to said bottom pier caps.

12. The support of claim 11 wherein:

said exterior surface of said top of each said second pier cap is substantially a horizontal planar member have friction enhancing texturing.

13. The combination of claim 11 wherein:

each said peripheral web of each said bottom pier cap includes:
a pair of side walls defining the lateral direction as between said side walls; and
a pair of end walls defining the longitudinal direction as between said end walls; said side walls of said bottom pier cap connected to said end walls of said bottom pier cap at a corner; and wherein:

said coupling means is located at a said corner or corners; the central area of said top of said bottom pier caps being substantially a horizontal planar member.

14. The combination of claim 13 wherein:

said coupling means includes:
a first projection connected to said body of said bottom pier cap and projecting above said top of said bottom pier cap; and
a second projection connected to said body of said first pier cap and projecting above said top of said bottom pier cap; said first and said second projections adapted for coupling with said webs of said second pier cap such that said second pier cap cannot move horizontally relative to said bottom pier cap when coupled thereto.

* * * * *